US005332356A

United States Patent [19]

Gülich

[11] Patent Number: 5,332,356

[45] Date of Patent: Jul. 26, 1994

[54] PROCESS AND A DEVICE FOR DETERMINING THE EROSION CAUSED BY CAVITATION IN COMPONENTS THROUGH WHICH FLUID FLOWS

[76] Inventor: Johann Friedrich Gülich, Burgstrasse 62b, Winterthur, Switzerland, 8408

[21] Appl. No.: 3,078

[22] Filed: Jan. 11, 1993

[30] Foreign Application Priority Data

Feb. 7, 1992 [EP] European Pat. Off. ..... 92810090.8

[51] Int. Cl.[5] ..... F04D 29/66

[52] U.S. Cl. ..... 415/118; 364/508

[58] Field of Search ..... 415/1, 16, 17, 26, 30, 415/47, 118; 364/508

[56] References Cited

U.S. PATENT DOCUMENTS

| | | | |
|---|---|---|---|
| 3,761,196 | 9/1973 | Weinert | 415/119 |
| 3,876,326 | 4/1975 | Weitz | 415/30 |
| 4,487,549 | 12/1984 | Takakusagi et al. | 415/30 |
| 4,538,957 | 9/1985 | Yamagata et al. | 415/1 |
| 4,687,410 | 8/1987 | Cline et al. | 415/17 |
| 4,781,525 | 11/1988 | Hubbard et al. | 415/30 |
| 4,839,830 | 6/1989 | Amey et al. | 364/508 |
| 4,936,658 | 7/1990 | Blotenberg | 415/1 |
| 5,140,529 | 8/1992 | Peifer | 364/508 |

FOREIGN PATENT DOCUMENTS

| | | | |
|---|---|---|---|
| 3520538 | 12/1986 | Fed. Rep. of Germany | 415/30 |
| 3520734 | 12/1986 | Fed. Rep. of Germany | 415/30 |

OTHER PUBLICATIONS

Patent Abstracts of Japan, vol. 14 No. 144, Publication No. JP 2010000; Jan. 12, 1990.

Patent Abstracts of Japan, vol. 11 No. 94, Publication No JP61244896; Oct. 31, 1986.

Database WPIL, Section EI, Week 8231, Derwent Publications Ltd., London, GB; No. SU-872972; Oct. 18, 1981.

World Pumps; May, 1991; No. 296, Oxford; p. 30.

*Primary Examiner*—John T. Kwon

*Attorney, Agent, or Firm*—Townsend and Townsend Khourie and Crew

[57] ABSTRACT

The erosion caused by cavitation in components through which fluid flows, such as, for example, a pump (1), can be derived by detecting the vibration in the pump casing. The fluid-borne noise caused by cavitation is transferred to the pump casing and is detected by a sensor (*7b*) of a structure-borne noise measuring device (*7a*), amplified, filtered and digitalized in a signal processing unit (10) and transmitted to a computer (11). Further measuring data detection devices such as the outlet pressure measuring device (6), the suction pressure measuring device (8), the fluid temperature measuring device (9) or the revolution counter (4) enable the computer (11) for example to calculate the flow rate or the correlation between the flow rate and the erosion rate. The values determined can be displayed via an output unit (13); for example, if a boundary value preset via an input unit (12) is exceeded, the output unit (13) activates a warning, for example.

32 Claims, 3 Drawing Sheets

6
5a
7a
1
3
4
2
M
7b
8
9
5b
14
10
11
12
13

PROCESS AND A DEVICE FOR DETERMINING THE EROSION CAUSED BY CAVITATION IN COMPONENTS THROUGH WHICH FLUID FLOWS

BACKGROUND OF THE INVENTION

The invention relates to a process for determining the erosion caused by cavitation in components through which fluid flows.

In the case of pumps and other components through which fluid flows, cavitation occurs in the fluid conveyed under certain conditions. Thus, for example, at the inlet edges of the impeller vanes of a centrifugal pump zones having low pressure, which result in the formation of steam bubbles, occur as a result of local excess speeds when the local pressure drops below the steam pressure of the fluid conveyed. The steam bubbles are rinsed with the flow in high-pressure zones, where they implode. A very high pressure peak and a very high cavitation intensity occur locally may cause material erosion and cavitation damage.

The continuous assessment of the hydrodynamic cavitation intensity and the erosion rate caused by cavitation in components such as pumps, turbines, automatic control valves shut-off valves. And after is known. A known method is to measure the fluid-borne noise. An empirically determined connection between the fluid-borne noise and the erosion rate permits the quantitative assessment of the potential risk of cavitation damage.

A corresponding process with a device for determining the erosion rate is known, for example, from "Guideline for prevention of Cavitation in Centrifugal Feedpumps, EPRI GS-6398, Project 1884-10, Final Report, Electric Power Research Institute, Palo Alto, Cal., 1989", Pages 2–24 and also Page B-9.

The measurement of the fluid-borne noise depends on a corresponding pressure measuring device which is inserted into the component through which fluid flows. direct contact with the fluid. The provision of a corresponding aperture in the outer wall of the component through which fluid flows is extremely problematic for safety reasons may be, for example in the nuclear industry. For this reason the known process is unsuitable for short-term inspection of existing plant equipment. A further disadvantage of the known process lies in the fact that the pressure gauge has to be fastened precisely inside tile component through which fluid flows for reasons relating to flow technology, in order to avoid measurement errors caused by air bubbles being deposited.

The object of the present invention is therefore to determine the erosion rate caused by cavitation without the necessity for a measuring sensor inside the component through which fluid flows.

SUMMARY OF THE INVENTION

This object is achieved according to the invention in that a structure-borne noise measuring device detects the structure-borne noise and the vibration of the outer wall of the component through which fluid flows respectively and transmits this information to a signal processing unit computer calculates the fluid-borne noise from the processed signal by numerical methods, determines the erosion rate therefrom and transmits it to an output unit.

The erosion caused by cavitation in components through which fluid flows, such as a pump, for example, can be derived by the detection of the vibration of the pump casing. The fluid-borne noise caused by cavitation is transmitted to the pump casing and is detected by means of a sensor of a structure-borne noise measuring device, the structure-borne noise is amplified, filtered and digitalized in a signal processing unit and transmitted to a computer. Further measurement data detection devices, such as a outlet pressure measuring device, the suction pressure measuring device, a fluid temperature measuring device or a revolution counter, enable the computer to calculate the flow rate or the correlation between the flow rate and the erosion rate, for example. The values determined can be indicated via an output unit, the output unit activating a warning, for example, should a boundary value preset by the input unit be exceeded.

The advantages of the invention are regarded as being that the determination of the erosion rate can be performed without intrusion into the component through which fluid flows another advantage is that the invention may be used temporarily and in the short term, e.g. for test purposes or inspection purposes.

The imploding steam bubbles cause pressure waves, which can be measured with a pressure gauge as fluid-borne noise. The pressure waves also vibrate the outer wall of the component through which fluid flows, e.g. a pump casing, which becomes manifest as structure-borne noise and can be measured by means of an acceleration meter attached to the outside of the pump casing. Both the fluid-borne noise and also the structure-borne noise are dependent on the hydrodynamic cavitation intensity, and are therefore potential measured variables for assessing the erosion caused by cavitation.

Cavitation damage only occurs if the four following conditions are met:

a) Steam bubbles are produced in the flowing fluid
b) the steam bubbles enter zones in which the local pressure exceeds the steam pressure
c) the steam bubbles implode close to a solid surface
d) the hydrodynamic cavitation intensity exceeds the cavitation resistance of the material.

As soon as imploding steam bubbles occur, pressure waves in the frequency range of typically above 10 kHz can be measured. It can therefore be clearly ascertained whether conditions a) and b) are satisfied. However hitherto no means have been known by which it is possible to ascertain by measuring the sound waves whether steam bubbles implode in the vicinity of the surface and are therefore potentially damaging, or whether the steam bubbles implode inside the fluid, where they are not damaging. The inability to ascertain whether condition c) has been satisfied is the most serious limitation, if a cavitation diagnosis is performed by measuring sound waves.

Nevertheless a diagnosis system enables an indication to be given whether the hydrodynamic cavitation intensity exceeds the cavitation resistance of the material, and thereby to quantify possible damage.

Empirical investigations have shown that there is a correlation between the metal loss caused by erosion produced by cavitation and the fluid-borne noise.

The known relationship is:

$$E_R = f(CNL) \quad (1)$$

in which $E_R$ corresponds to the erosion rate (in mm/h) and CNL (Cavitation Noise Level) corresponds to the fluid-borne noise level caused by cavitation.

However no correlation could be ascertained between the casing vibration CV and the erosion rate $E_R$.

The equation $$P_{ER}=U_R \cdot E_R \quad (2)$$

describes the connection between the specific erosion rate $P_{ER}$ as a product of the maximum local erosion rate $E_R$ with the material-dependant material constant $U_R$. Empirical investigations showed a correlation between the specific erosion rate $P_{ER}$ and also the acoustic fluid-borne noise intensity $I_{ac}$ (equation 3).

$$P_{ER}=C_N \cdot F_{cor}/F_{Mat}(I_{ac}/I_R)^X \quad (3)$$

with the empirical constants $C_N$ and x.

wherein:

$F_{cor}$: corrosion factor;

$F_{Mat}$: factor for metallurgical structure;

$I_{ac}$: acoustic intensity;

$I_R$: reference variable.

The measured acceleration of the outer wall of a component through which fluid flows, such as, for example, a pump casing, is an indication of the pressure variations in the fluid inside the component. It is possible to determine the fluid-borne noise NL on the basis of the casing vibration CV by acoustic methods such as the statistical energy analysis or by determining the transfer function, for example (equation 4).

$$NL=f(CV) \quad (4)$$

Therefore the acoustic intensity $I_{ac}$ of the fluid-borne noise can be determined from the casing vibration CV and therefrom the corresponding erosion rate $P_{ER}$. The erosion rate $P_{ER}$ and thus the erosion rate $E_R$ can therefore be calculated from the casing vibration CV.

The invention is described below by means of exemplified embodiments and examples for application.

BRIEF DESCRIPTION OF THE DRAWINGS

FIG. 1 shows a pump 1, which is driven by a motor 2 via a rotating shaft 3. The pump conveys a fluid from the suction line 5b to the delivery line 5a. A structure-borne measuring device 7 detects the vibrations of the outer wall of the pump 1, it being possible to connect the structure-borne noise measuring device 7 securely to the outer wall or the structure-borne noise measuring device 7 scanning the vibrations of the outer wall without contact. The structure-borne noise measuring device 7 may lie on the outer wall or be inserted to a chosen depth through a bore hole, for example, into the wall. The signal processing unit 10 processes the vibration signal CV for example by amplifying, filtering and/or digitizing the signal. The computer 11, for which values can be preset by the input unit 12, and which transmits the calculated values to the output unit 13, calculates the fluid-borne noise NL from the processed vibration signal and by using the empirical correlation according to equation 3 the specific erosion rate $P_{ER}$ and also by using equation 2 the minimum local erosion rate $E_R$. The output unit 13 may also indicate the accumulated erosion, for example, or when a preset threshold is exceeded, for example for maximum local erosion rate $E_R$, trigger a signal, such as an alarm.

Figure 1:
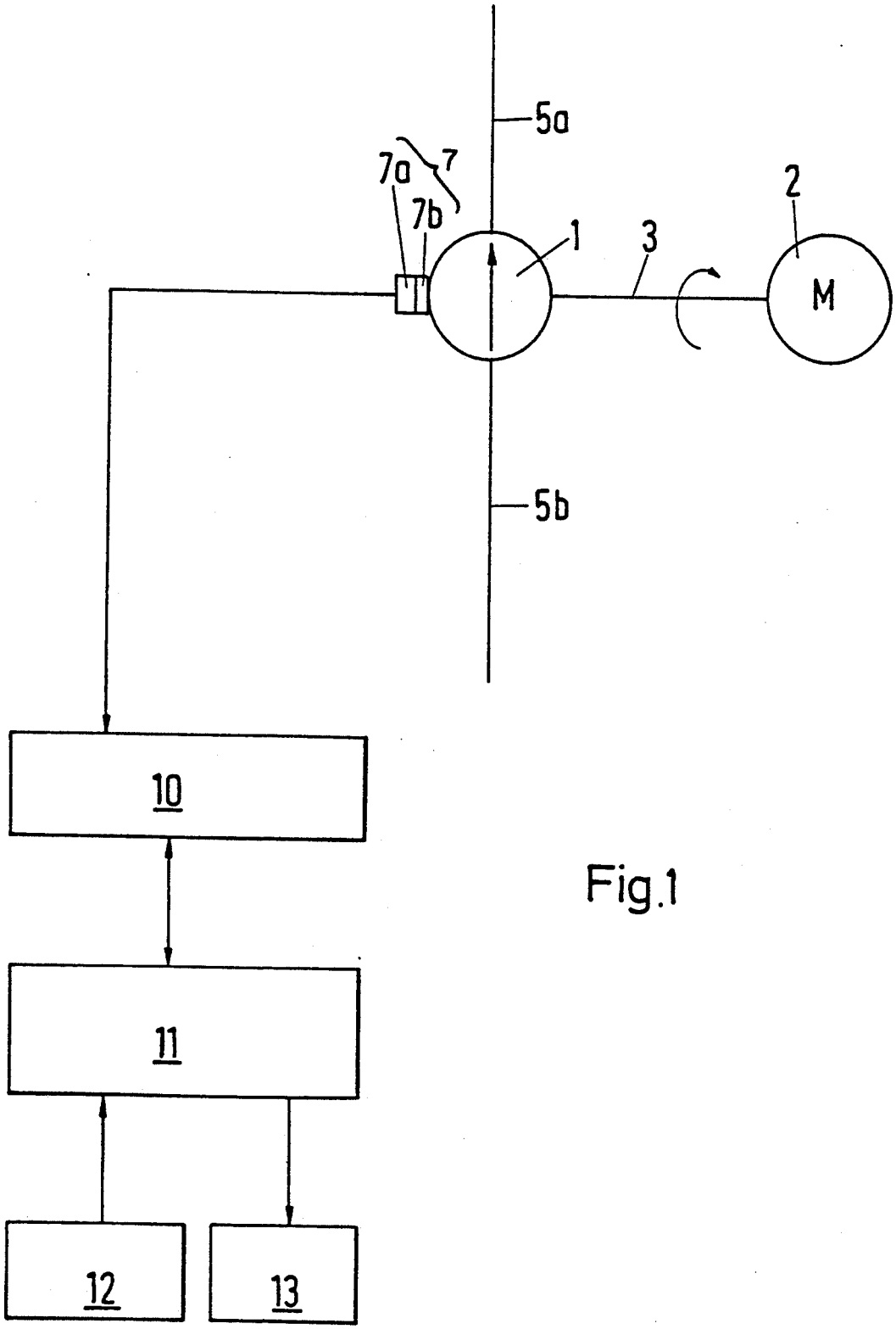
FIG. 1 shows a diagrammatical arrangement of a device for determining the erosion caused by cavitation in a pump.
Figure 2:
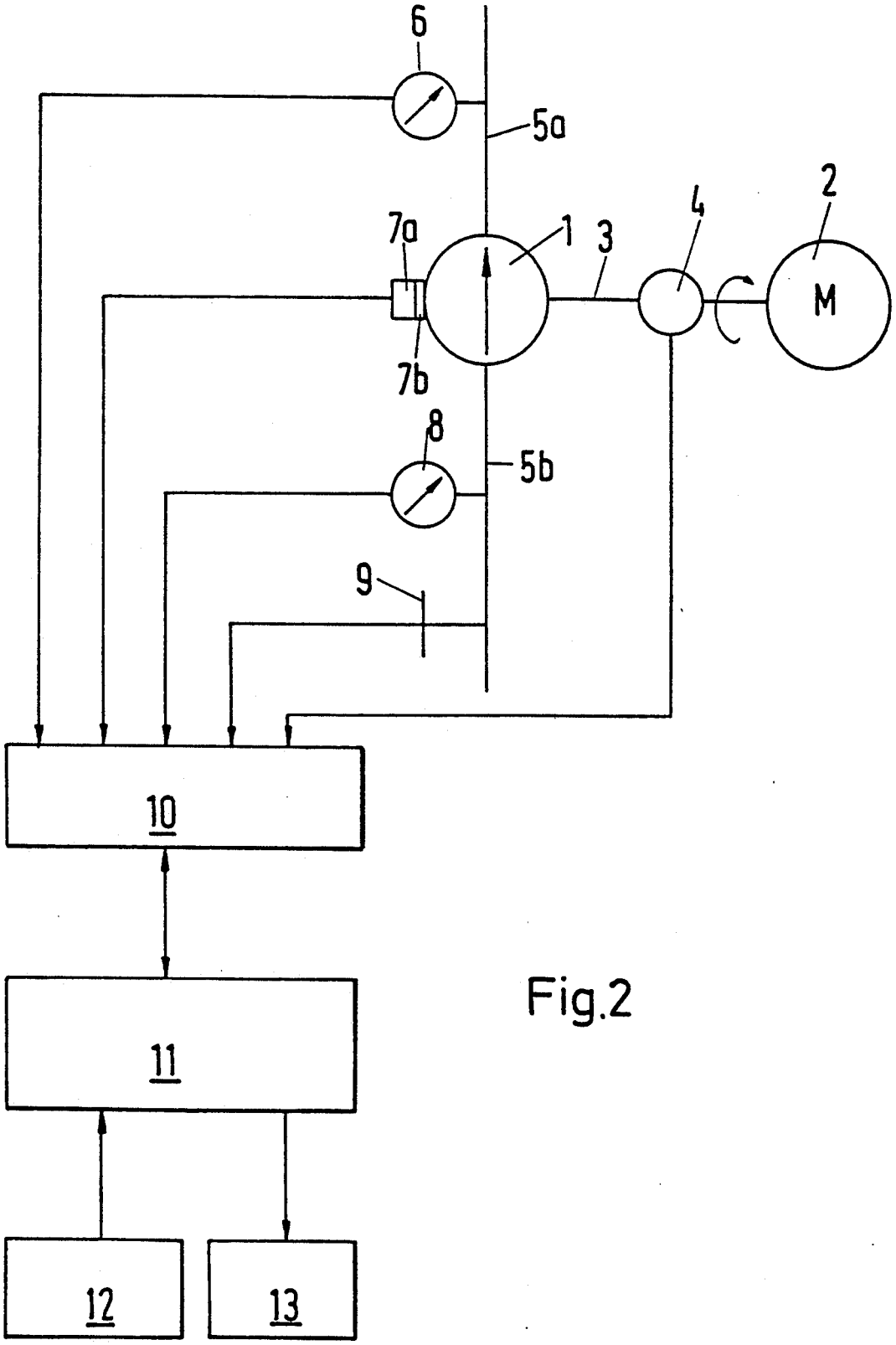
FIG. 2 shows a diagrammatical arrangement of a device for determining the erosion caused by cavitation and also the flow rate.

When compared with FIG. 1, FIG. 2 comprises additional measuring devices, i.e. an outlet pressure measuring device 6, a suction pressure measuring device 8, a fluid temperature measuring device 9 and also a revolution counter 4. The additional measuring devices when compared with FIG. 1 permit the computer 11 to calculate the present flow rate of the pump, the operating point of the pump and also to convert the discharge pressure to a reference pressure with a reference velocity of the shaft 3. The evaluation of the data prepared by the signal processing device 10 enables the computer 11 to calculate the following magnitudes, for example:

NPSH, net positive suction head of pump 1;

flow rate;

fluid-borne noise;

present erosion rate;

load histogram;

histogram with load and erosion rate;

accumulated erosion.

Figure 3:
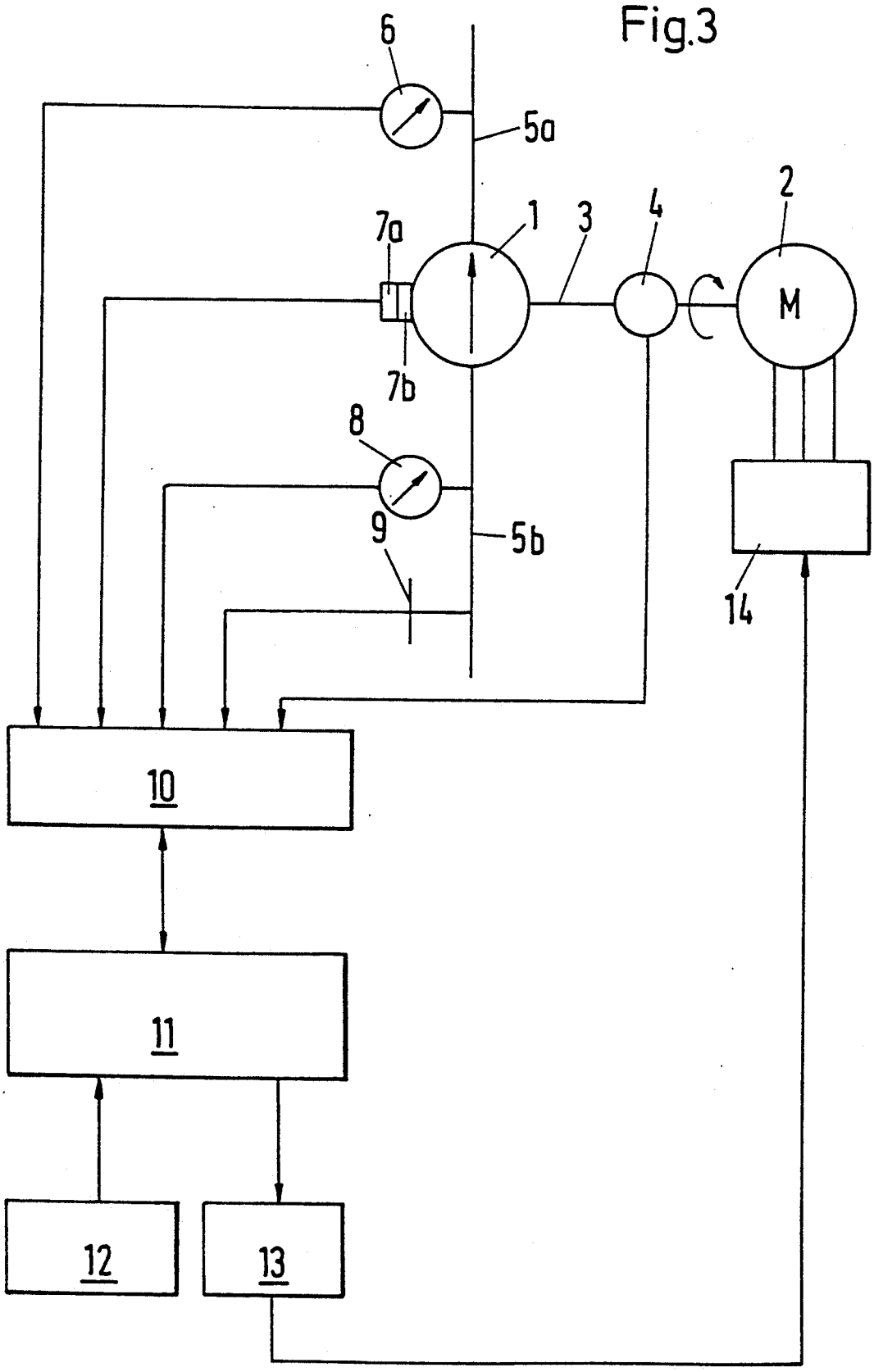
FIG. 3 shows a diagrammatical arrangement of a device for influencing the erosion caused by cavitation of a pump.

FIG. 3 shows the same measuring devices as FIG. 2. The speed of the motor 2 can be controlled via a regulating device 14, which in turn is controlled by the output unit 13 of the computer 11. This closed control loop permits, for example, the flow rate of the pump 1 to be determined independently of the erosion rate. A closed control loop of this type enables the working point of the pump to be altered by adjusting the motor speed or for example by adjusting the position of a valve so that the pump operates in a region in which there is a low risk of cavitation.

The exemplified embodiments and examples for application described may of course be realised if the fluid-borne noise NL is available directly via a pressure gauge.

I claim:

1. A method for determining the erosion rate caused by cavitation in components through which fluid flows, comprising the steps of:

measuring the vibration of an outer wall of the component of at least one point;

calculating a fluid-borne noise using the vibration; and calculating an erosion rate using the fluid-borne noise and an empirically determined relationship between the fluid-borne noise and the erosion rate.

2. A method according to claim 1, wherein:

the fluid-borne noise calculating step is carried out using a statistical energy analysis.

3. A method according to claim 1, wherein:

the fluid-borne noise calculating step is carried out using a transfer function.

4. A method according to claim 1 wherein:

the empirically determined relationship between the fluid-borne noise and the erosion rate includes a metallurgical structure factor.

5. A device for determining the erosion rate caused by cavitation in a component through which fluid flows, comprising:

a measuring sensor having means for detecting a vibration of the component and means for producing a vibration signal;

a signal processing unit having means for receiving the vibration signal from the measuring sensor and means for processing the vibration signal and producing a processed signal; and a computer having means for receiving the processed signal from the signal processing unit and means for calculating a value representing the fluid-borne noise from the processed signal by a numerical method, the computer further comprising means for determining an erosion rate from the value representing the fluid-borne noise.

6. A device according to claim 5, wherein:

the measuring sensor is coupled to an outer wall of the component and inside the component through which the fluid flows.

7. A device according to claim 4, wherein: the measuring sensor is adapted to the coupled to an outer wall of the component, outside the component.

8. A device according to claim 4, wherein:

the means for detecting a vibration measures the vibration of an outer wall of the component without contacting the outer wall of the component.

9. A device according to claim 5, further comprising:

an outlet pressure measuring device coupled to the signal processing unit;

a suction pressure measuring device coupled to the signal processing unit; and a fluid temperature measuring device coupled to the signal processing unit; and the computer further comprising means for determining a flow rate through the component.

10. A device according to claim 5, further comprising:

a revolution counter having means for transmitting a rotational speed of a shaft of the component via the signal processing unit to the computer.

11. A device according to claim 5, further comprising:

an output unit coupled to the computer, the output unit having means for notifying whether the erosion rate exceeds a predetermined threshold value.

12. A device according to claim 5, further comprising:

an output unit coupled to the computer, the output unit having means for determining whether the erosion rate exceeds a predetermined threshold value, the output unit also comprising means for adjusting a flow rate through the component when the erosion rate exceeds the predetermined threshold value.

13. A device according to claim 5 wherein:

the component is a fluid pump.

14. A device according to claim 5 wherein:

the empirically determined relationship between the fluid-borne noise and the erosion rate includes a corrosion factor.

15. A device according to claim 5 wherein:

the erosion rate determining means of the computer calculates the erosion rate using an empirically determined relationship between the fluid-borne noise and the erosion rate.

16. A device according to claim 15 wherein:

the empirically determined relationship between the fluid-borne noise and the erosion rate includes a corrosion factor.

17. A device according to claim 15 wherein:

the empirically determined relationship between the fluid-borne noise and the erosion rate includes a metallurgical structure factor.

18. A method for determining the erosion rate caused by cavitation in components through which fluid flows, comprising the steps of:

measuring the structure-borne noise of an outer wall of the component at at least one point;

calculating a fluid-borne noise using the structure-borne noise; and calculating an erosion rate using the fluid-borne noise and an empirically determined relationship between the fluid-borne noise and the erosion rate.

19. A method according to claim 18, wherein:

the fluid-borne noise calculating step is carried out using a statistical energy analysis.

20. A method according to claim 18, wherein:

the fluid-borne noise calculating step is carried out using a transfer function.

21. A device for determining the erosion rate caused by cavitation in a component through which fluid flows, comprising:

a measuring sensor having means for detecting a structure-borne noise of the component and means for producing a structure-borne noise signal;

a signal processing unit having means for receiving the structure-borne noise signal from the measuring sensor and means for processing the structure-borne noise signal and producing a processed signal; and a computer having means for receiving the processed signal from the signal processing unit and means for calculating a value representing the fluid-borne noise from the processed signal by a numerical method, the computer further comprising means for determining an erosion rate from the value representing the fluid-borne noise.

22. A device according to claim 21, wherein:

the means for detecting a structure-borne noise measures a structure-borne noise of an outer wall of the component without contacting the outer wall.

23. A device according to claim 21, further comprising:

an outlet pressure measuring device coupled to the signal processing unit;

a suction pressure measuring device coupled to the signal processing unit;

a fluid temperature measuring device coupled to the signal processing unit; and the computer further comprising means for determining a flow rate through the component.

24. A device according to claim 21, further comprising:

a revolution counter having means for transmitting a rotational speed of a shaft of the component via the signal processing unit to the computer.

25. A device according to claim 21, further comprising:

an output unit coupled to the computer, the output unit having means for notifying whether the erosion rate exceeds a predetermined threshold value.

26. A device according to claim 21, further comprising:

an output unit coupled to the computer, the output unit having means for determining whether the erosion rate exceeds a predetermined threshold value, the output unit also comprising means for adjusting a flow rate through the component when the erosion rate exceeds the predetermined threshold value.

27. A device according to claim 21 wherein:

the component is a fluid pump.

28. A method according to claim 18 wherein:

the empirically determined relationship between the fluid-borne noise and the erosion rate includes a metallurgical structure factor.

29. A device according to claim 21 wherein:

the empirically determined relationship between the fluid-borne noise and the erosion rate includes a corrosion factor.

30. A device according to claim 21 wherein:

the erosion rate determining means of the computer calculates the erosion rate using an empirically determined relationship between the fluid-borne noise and the erosion rate.

31. A device according to claim 21 wherein:

the empirically determined relationship between the fluid-borne noise and the erosion rate includes a corrosion factor.

32. A device according to claim 30 wherein:

the empirically determined relationship between the fluid-borne noise and the erosion rate includes a metallurgical structure factor.

* * * * *